United States Patent [19]

Mente et al.

[11] Patent Number: 4,818,466

[45] Date of Patent: Apr. 4, 1989

[54] PROCESS FOR THE PRODUCTION OF NON-WOVEN MATERIAL FROM ENDLESS FILAMENTS

[75] Inventors: Kurt Mente, Hanover; Gerhard Knitsch, Wedemark, both of Fed. Rep. of Germany

[73] Assignees: J. H. Benecke, AG, Hanover; Corovin GmbH, Peine, both of Fed. Rep. of Germany

[21] Appl. No.: 932,555

[22] Filed: Nov. 20, 1986

[30] Foreign Application Priority Data

Nov. 21, 1985 [DE] Fed. Rep. of Germany ..... 3541127

[51] Int. Cl.[4] ..... D01D 11/02

[52] U.S. Cl. ..... 264/555; 264/210.2; 264/210.8; 264/211.14; 156/167; 19/299

[58] Field of Search ..... 239/8, DIG. 7, 419.5, 239/424, 597; 264/13, 518, 517, 115, 121, 555, 210.2, 210.8, 211.14; 19/299; 156/167

[56] References Cited

U.S. PATENT DOCUMENTS

| | | | |
|---|---|---|---|
| 3,734,803 | 5/1973 | Lipscomb et al. | 156/167 |
| 3,736,211 | 5/1973 | Lipscomb et al. | 156/167 |
| 3,738,894 | 6/1973 | Lipscomb et al. | 156/167 |
| 3,991,250 | 11/1976 | Hartmann et al. | 156/167 |
| 4,346,504 | 8/1982 | Birk et al. | 264/555 |
| 4,557,637 | 12/1985 | Barclay et al. | 239/DIG. 7 |
| 4,578,134 | 3/1986 | Hartmann | 156/167 |

FOREIGN PATENT DOCUMENTS

| | | |
|---|---|---|
| 1785158 | 8/1968 | Fed. Rep. of Germany . |
| 1936354 | 7/1969 | Fed. Rep. of Germany . |
| 2200782 | 1/1972 | Fed. Rep. of Germany . |
| 1282176 | 7/1972 | United Kingdom . |
| 1297582 | 11/1972 | United Kingdom . |

*Primary Examiner*—Jan H. Silbaugh
*Assistant Examiner*—Hubert C. Lorin
*Attorney, Agent, or Firm*—Cushman, Darby & Cushman

[57] ABSTRACT

To produce non-woven materials, endless filaments in the form of a warp are drawn off a filament draw-off nozzle to which are joined a filament offlet, a filament guide tube and a spreading extruder. An amount of compressed air under high pressure is admitted to the filament draw-off nozzle, and by means of the spreading extruder provided with Coanda shells the warp is loosened before impacting on a screen conveyor. In order to achieve as evenly as possible a distribution and loosening of the warp, slot nozzles are provided on either side of the spreading extruder, which are supplied with a reduced amount of compressed air under relative low pressure. Simultaneously, a reduction of the amount of compressed air at the filament drawoff nozzle takes place. The additional air, supplied via the slot nozzles, surprisingly makes possible a considerable improvement in the spreading of the warp, and at the same time a savings in energy is also achieved in connection with the reduction of the amount of compressed air at the filament draw-off nozzle, while the filament draw-off force is maintained.

5 Claims, 6 Drawing Sheets

PROCESS FOR THE PRODUCTION OF NON-WOVEN MATERIAL FROM ENDLESS FILAMENTS

BACKGROUND OF THE INVENTION

The invention relates to a process for the production of non-woven material from endless filaments which are drawn off from spinnerets in the form of a warp by means of a gaseous propellant and are deposited, after moving through a tube-like filament draw-off device, on a substrate for the formation of the non-woven material. To obtain a desired filament draw-off force, the gaseous propellant is supplied to a filament draw-off nozzle, located at the input side of the filament draw-off device, with a set input pressure (compressed air pressure) and with a set input volume (amount of compressed air), and wherein the warp is spread before being deposited by means of a spreading extruder having Coanda shells adjoining the filament draw-off device, and furthermore, the invention relates to an apparatus for carrying out the process.

Processes and apparatus of the species mentioned above are known from German patent No. 1 785 158, British patent No. 1 282 176 and British patent No. 1 297 582. There a warp coming from a liquefied material and through spinnerets is guided through a filament draw-off device having a filament draw-off nozzle at its upper end fed with highly compressed air.

The so-called Lavalle enlargement adjoins the narrowest annular slit of the filament draw-off nozzle at the exit of which low pressure is generated, which also occurs via a small inner filament-guide at the input side of the filament draw-off nozzle and makes possible the threading of the warp.

A filament offlet with an inner diameter of the Lavalle enlargment adjoins the Lavalle enlargement, into which air flows at supersonic speed. After about half the distance of the filament offlet of a total length of approximately 250 mm a compression shock with following subsonic flow occurs, which further slows inside the adjoining filament guide tube having a four- to six-fold diameter.

Within the filament draw-off device consisting of the filament offlet and the filament guide tube the drawing of the filaments takes place, which thereby become thinner. The substantial part of the filament draw-off force is provided by the filament offlet. The object of the filament guide tube is only to transport the warp to a spreading extruder equipped with Coanda shells and, in order to distribute the filaments and to spread them before they fall or impact on a substrate for the formation of the non-woven material.

The Coanda effect utilized here as well as the Coanda shells mentioned have already been described in detail in German patent No. 1 936 354 and German laid-open publication DE-OS No. 2 200 782 (see FIG. 5*b* there).

The spreading of the warp by the spreading extruder is of crucial importance for the quality and structure of the non-woven material. The more even the spreading or distribution, the better the quality of the non-woven material.

Although the known spreading extruder with Coanda shells in principle makes possible a spreading of the warp by means of flow techniques, in actuality it could be observed again and again that the eveness of the structure of the non-woven material left something to be desired and that there were limits in regard to the quality of the non-woven material. This was caused by an insufficient spreading or distribution of the warp.

It is the object of the invention to create a process making possible an even spreading or distribution of the warp by means of the spreading extruder in order to increase the quality of the non-woven material. Furthermore, the invention is to provide an apparatus for carrying out the process.

SUMMARY OF THE INVENTION

To achieve this object it is provided in the process described in the preamble of claim 1 to additionally supply the spreading extruder externally with a gaseous propellant, having a lesser pressure and volume as compared to the input pressure and volume, by means of a slot nozzle.

The invention is based on the surprising realization that it is possible, by the external supply of an amount of air in the area of the spreading extruder, to obtain and considerably improve the spreading effect desired for an increase in quality, whereby the structure of the non-woven material becomes more even. In an appropriate embodiment of the invention the slot nozzles have Laval enlargements operating in the low pressure areas, whereby the warp is also loosened by means of outwardly directed shock waves crosswise to the longitudinal slit of the spreading extruder for a better and more even distribution. A low pressure occurs at the exit openings of the Laval enlargements of the slot nozzles located on both sides of the spreading extruder. At the exit of the spreading extruder proper ambient air pressure obtains, so that as a result the outwardly directed shock waves are created which also separate and distribute the warp crosswise to the longitudinal slit of the spreading extruder.

In an advantageous embodiment of the invention the input pressure and the input volume at the filament draw-off nozzle are simultaneously reduced, and the ratio of length to diameter of the filament offlet forming the filament draw-off device and of the filament guide tube are selected such that the filament draw-off power present at the spreading extruder is maintained without additional supply of propellant.

Another important advantage of the invention consists in the fact that, while maintaining the filament draw-off force and with the definitely improved spreading of the warp by the spreading extruder, a considerable savings in energy can be obtained at the same time.

As is generally known, large compressors with a power consumption of 800 to 900 kW are required to carry out a process for the production of non-woven materials in order to generate the huge amounts of compressed air for the filament draw-off nozzles, because customarily a plurality of filament draw-off devices with filament draw-off nozzles are placed in parallel in order to make large-area non-woven materials. The isothermal compression output is calculated according to the formula $$N = const.\ ln\ (p_o/p) \times v_o$$

Based on a numerical example the energy and cost savings will be further explained in the following. In the known process presupposed in the preamble of claim 1, the following values are customary for the amount of compressed air, $v_o$ and the compressed air pressure $p_o{:}v_o = 72\ Nm^3/h$ and $p_o = 21$ bar. From this can be calculated an isothermal compression output of $N=k\times219.2$ (k is a constant; thus, of importance here is the value 219.2).

Proceeding from the above values the circumstances in regard to the invention are as follows: at the filament draw-off nozzle the amount and the pressure of the compressed air are reduced to $v_1=52.4$ $Nm^3/h$ and $p_1=16$ bar. This results in a compression output of $N_1=k\times145.3$.

The following values are used as basis at the slot nozzle in the area of the spreading extruder: $v_3=19.6$ $Nm^3/h$ and $p_3=1.9$ bar. The isothermal compression output therefore is $N_3=k\times12.6$.

An addition of $v_1$ and $v_3$ results in the above presupposed value of $v_o=72$ $Nm^3/h$, i.e. the reduction of the amount of compressed air at the filament draw-off nozzle therefore can be used for the amount of compressed air at the slot nozzle. Important is the energy balance, because the sum of $N_1$ and $N_3=k\times157.9$ is smaller than the value of $N=k\times219.2$, calculated above in regard to the known process. The result is a savings in energy of approximately 28%, while still retaining the filament draw-off force and at the same time decisively improving the spreading by the spreading extruder.

The spreading and even distribution of the warp by the spreading extruder can be further improved if, in a practical embodiment of the invention, an additional amount of compressed air is supplied via a propelling nozzle between the lower end of the filament offlet and the spreading extruder. In this case the following values can be used: $v_1=52.4$ $Nm^3/h$, $p_1=16$ bar; at the propelling nozzle: $v_2=25$ $Nm^3/h$, $p_2=1.9$ bar; at the slot nozzle: $v_3=22.6$ $Nm^3/h$, $p_3=1.9$ bar. The several isothermal compression outputs then are: $N_1=k\times145.3$; $N_2=k\times16.0$ and $N_3=k\times14.5$. Altogether the isothermal compression output therefore is $N=k\times175.8$, so that with additional supply of propellant at the propelling nozzle as well as at the slot nozzle there still is obtained at the considerable energy savings of approximately 20% and that again is with a simultaneous improvement of the spreading and distribution of the warp at the spreading extruder.

Based on the physical laws in regard to the isothermal compression output, the filament draw-off force, the flow-through resistance of the filament draw-off device and the requirement that an underpressure of from 0.6 to 0.8 bar should prevail at the suction orifice of the filament draw-off nozzle in order to be able to insert the warp into the filament draw-off nozzle, and further based on the requirement that the filament draw-off force for obtaining a predetermined filament titre cannot be reduced, a ratio of length of diameter of the filament draw-off of $1/d=80$ to 180, depending on polymer and titre, has proven effective. Moreover, the dimensions and sizes of the filament offlet can be freely selected as long as the flow-through resistance of 0.01 bar is not exceeded.

Further practical embodiments and advantageous improvements of the invention are recited in the subclaims and can be seen from the drawings.

In the following, the invention is further described by means of the exemplary embodiments shown in the drawings.

DETAILED DESCRIPTION

Figure 1:
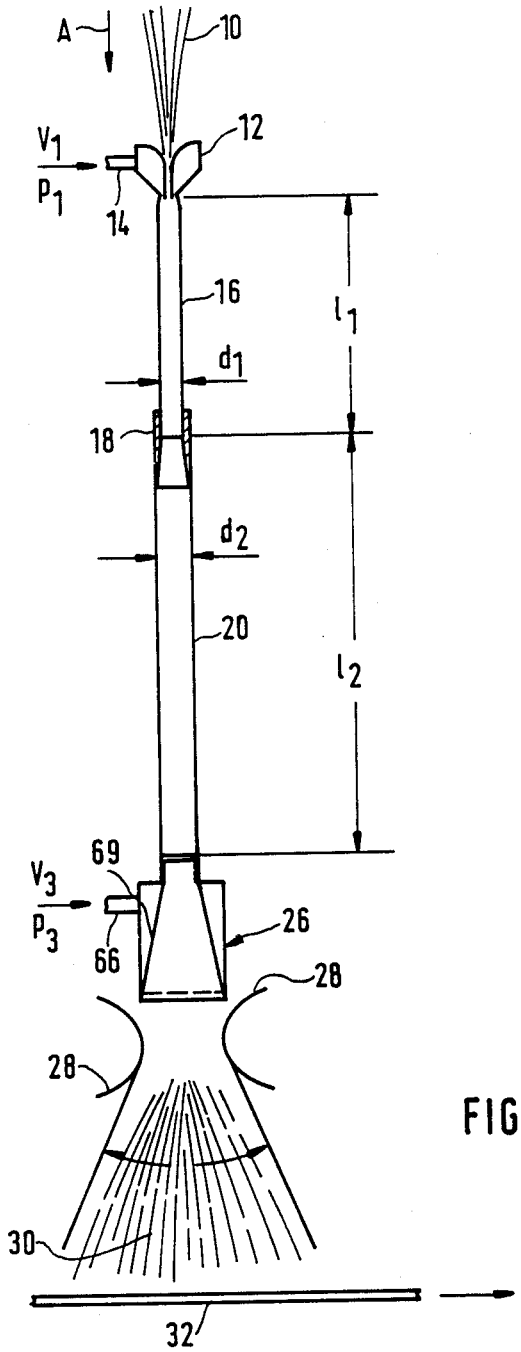
FIG. 1 is a schematic view of an apparatus for the production of a non-woven material with a slot nozzle.

In the apparatus shown in FIG. 1, endless filaments 10 are drawn in the direction of the arrow A by a, per se, known filament draw-off nozzle 12. The endless filaments are produced in the customary way from a liquefied material and are drawn through spinnerets not shown in the drawing.

The filament draw-off nozzle 12 has a compressed air connector 14 for the supply of an amount of compressed air $v_1$ under pressure $p_1$. A filament offlet 16 adjoins the filament draw-off nozzle 12, and a filament guide tube 20 is connected via a forcing cone 18.

The endless filaments drawn off at the top emerge from the bottom of a spreading extruder 26 which is provided with Coanda shells 28. The so-called Coanda effect is used here to spread the filaments 30 before they impact on a screen conveyor 32 which is air-permeable and under vacuum, whereby the non-woven material—for instance polypropylene non-woven material—is formed.

The filament draw-off force is mainly created in the filament offlet 16, through the first half of which air flows at supersonic speed and, after the compression shock, with subsonic speed. The filaments thus reach speeds of from 30 to 100 m/s, depending on the size of the filament titre. The flow-through resistance is kept low by means of the forcing cone 18, located between the filament offlet 16 and the filament guide 12. The apparatus so far described is known.

Additional slot nozzles 69 are disposed on both sides of the spreading extruder 26, the detailed construction of which will be described below by means of FIGS. 4 to 6. Therefore an additional supply of compressed air with the volume $v_3$ and a pressure $p_3$ takes place in the area of the spreading extruder 26 via a compressed via connector 66. At the same time the input volume $v_1$ and, if required, the input pressure $p_1$ at the filament draw-off nozzle 12 are reduced. The filament guide tube 20 is of such dimensions that the flow-through resistance is less than 0.01 bar and the ratio of length to diameter $l_1/d_1$ of the filament offlet 16 is of such dimensions that that filament drawoff force is maintained which is present without the additional supply of compressed air via the compressed air connector 66.

The spreading effect can be influenced by means of the slot nozzles 69 with the additional amount of air $v_3$ and can be adjusted to an optimal spreading. Therefore the filaments 30 are distributed more evenly, by which the quality of the non-woven material is improved. It has been shown in a surprising way that, with an increase in the amount of air, the spreading angle of the Coanda shells becomes larger and thereby the distribution of the warp more even.

Figure 2:
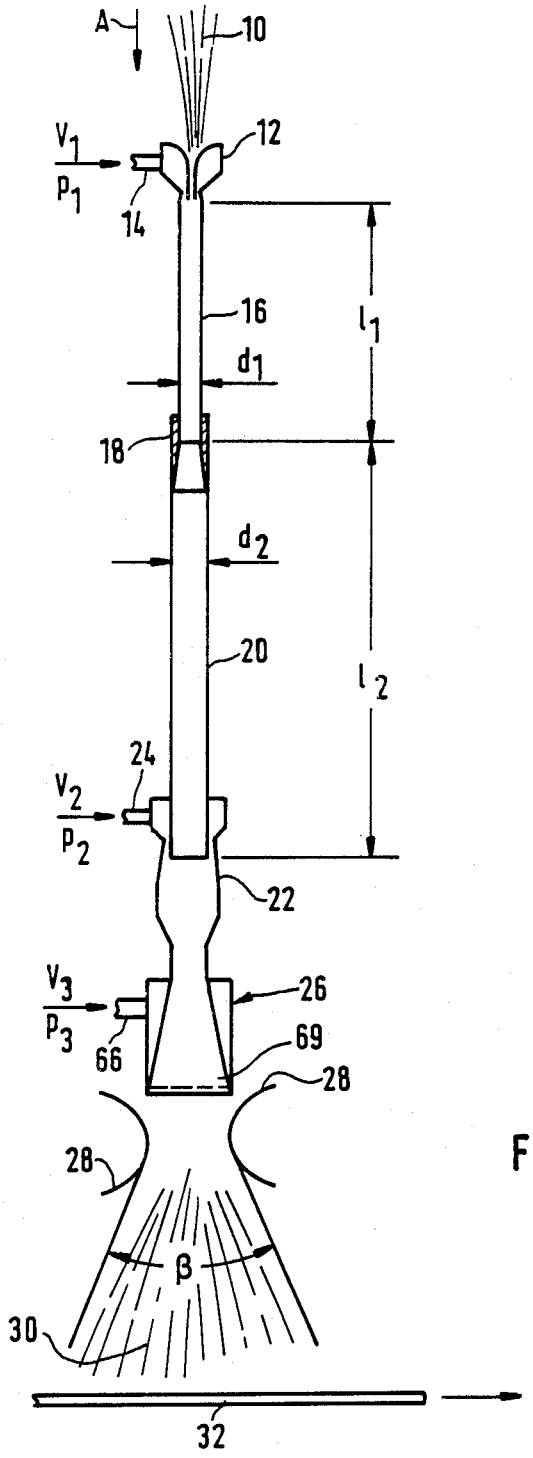
FIG. 2 is an apparatus according to FIG. 1 with an additional propelling nozzle.

In the apparatus in accordance with FIG. 2 an additional nozzle between the spreading extruder 26 and the filament guide tube 20 is embodied as propelling nozzle 22, and an additional amount of air $v_2$ with a pressure $p_2$ is supplied at this point via a compressed air connector 24. By this means a further improvement of the spreading or distribution of the warp at the Coanda shells 28 can be achieved.

Here, too, the volume and pressures are selected such that the filament draw-off force remains even. In spite of this it is possible—as established above—to obtain a considerable energy savings.

Figure 3:
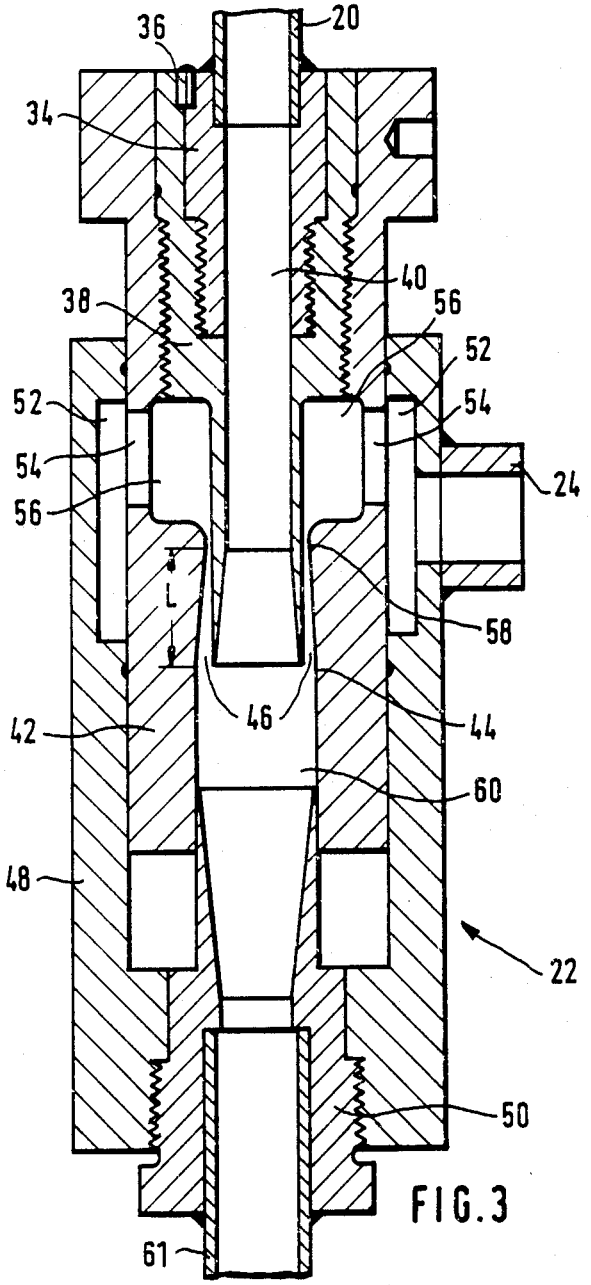
FIG. 3 is a diametrical section of a propelling nozzle according to claim 2.

The detailed construction of the propelling nozzle 22, welded together with the filament guide tube 22, can be seen in FIG. 3. The propelling nozzle 22 comprises a first threaded element 34, which is screwed together with a second threaded element 38 and secured against torsion by a straight pin 36. Together, the first threaded element 34 and the second threaded element 38 form a tube extension 40.

The propelling nozzle 22 further comprises a rotatable adjustment ring 42 movable in an axial direction by rotation, as well as a casing 48 and a cone-shaped junction element 50, which is welded together with a connecting tube 61 leading to the spreading extruder 26.

A pre-chamber 52 adjoins the compressed air connector 24 within the propelling nozzle 22, which is connnectedvia bores 54 with a compression chamber 56. The inner wall of the adjustment ring 42 forms, from the compression chmaber 56 to the filament guide chamber 60, a connection having a narrowest cross section 58 and a Laval enlargement 46 with an air output 44. The length L of the Laval enlargement 46 can be changed by rotation of the adjustment ring 42 in order to set the air pressure at the air output 44. The casing 48 as well as the first threaded element 34 are fixed axially and radially.

The compressed air $v_2$, $p_2$ flows through the compressed air connector 24 into the pre-chamber 52 and via the bores 54 into the compression chamber 46 and then through the narrowest cross section 58 to the air output 44. To keep the flow-through resistance of the propelling nozzle 22 low, the second threaded element 38 at its end or output side and the cone-shaped junction element 50 at its input side are conically expanded.

Figure 4:
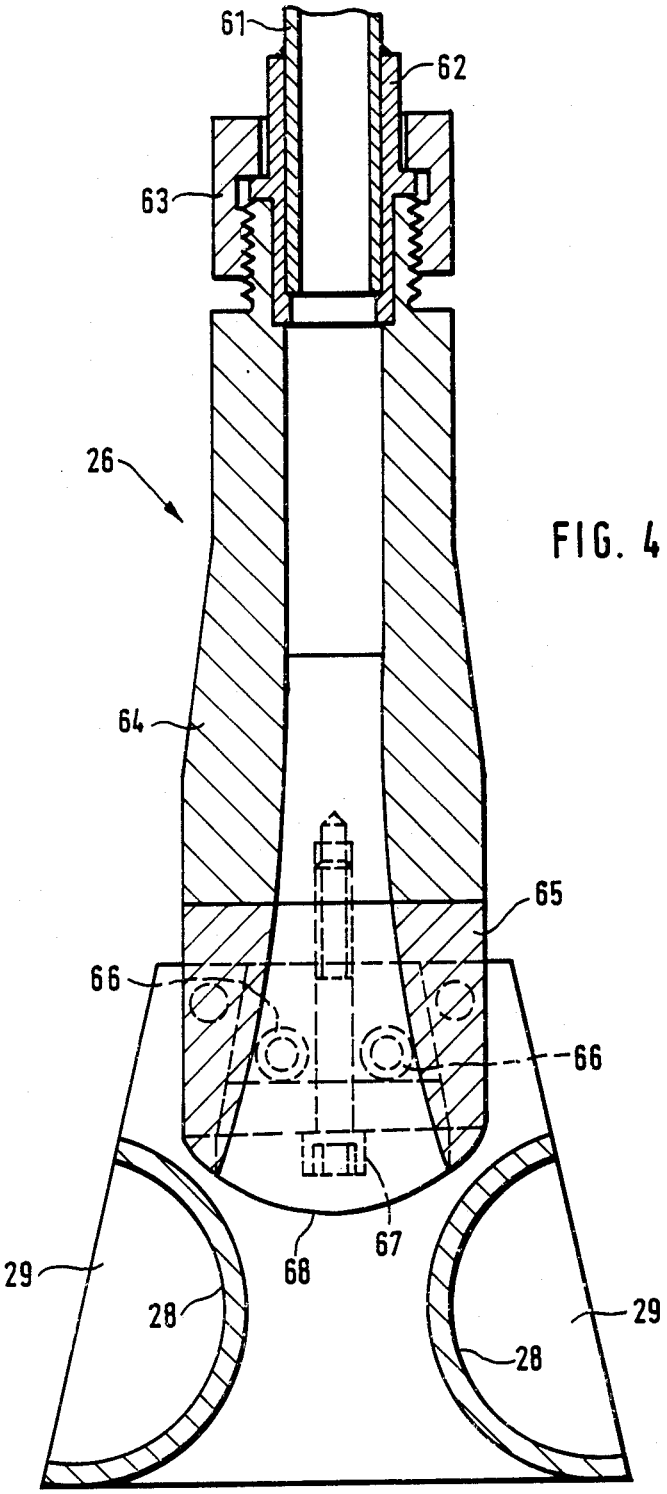
FIG. 4 is a first diametrical view of a spreading extruder having slot nozzles.
Figure 5:
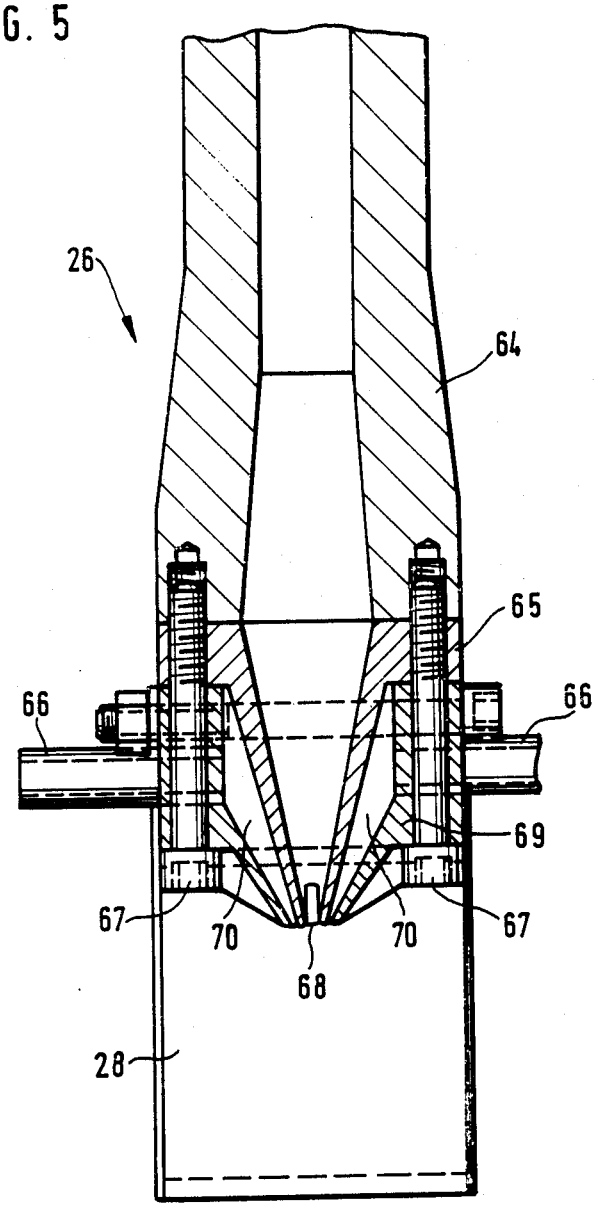
FIG. 5 is another diametrical view of the spreading extruder according to FIG. 4.
Figure 6:
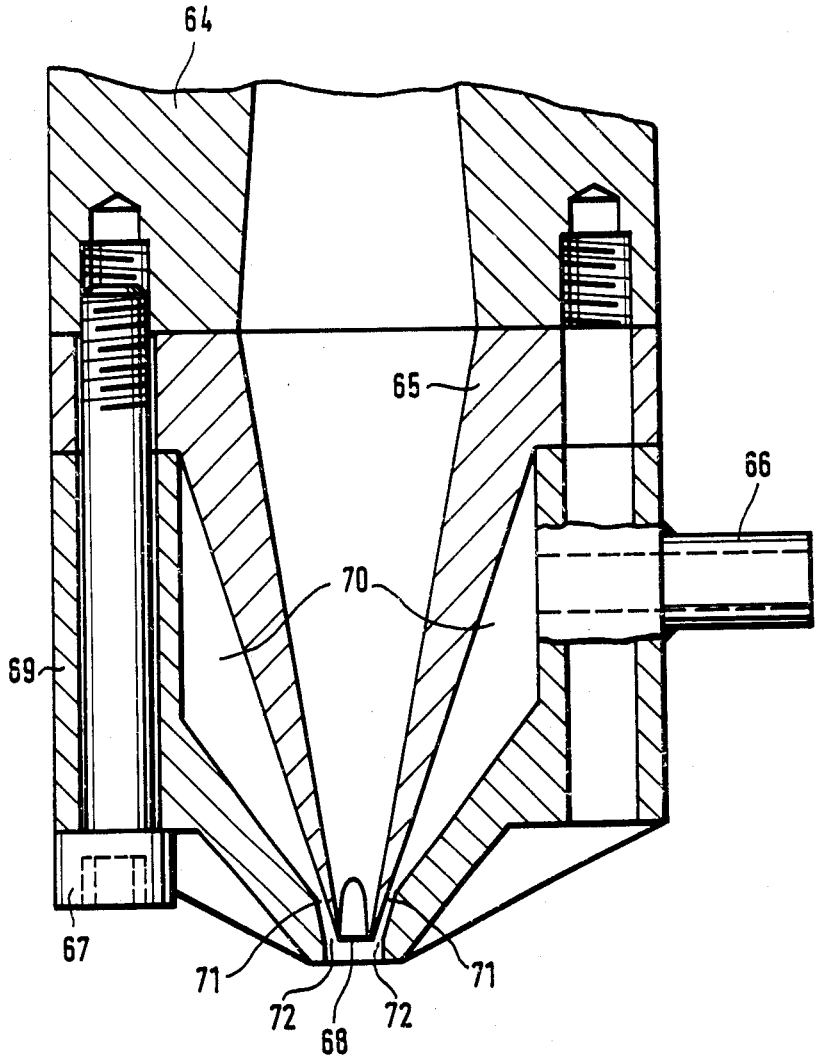
FIG. 6 is a detailed diametrical view of the lower exit area of the spreading extruder according to FIG. 5.

The spreading extruder 26, shown in FIGS. 4 to 6, adjoins the connecting tube 25, secured by a tube casing 62 and a swivel nut 63.

The spreading extruder 26 consists of an upper part 64 and a lower part 65. The inner bore in these parts changes, in a way per se known, from a circular to a slit-like cross section at the exit 68. Here are located the Coanda shells 28 secured by a suspension 29.

On either side of the spreading extruder 26 are two slot nozzles 56 each, having compressed air connectors 66. Each compressed air connector 66 leads into a compression chamber 70 of the slot nozzle, which is secured by means of screws 67 on the spreading extruder 26. The fastening of the slot nozzle body 69 by means of the screws 67 can be seen especially clearly in FIG. 6 (for greater readability of the drawing, in FIG. 6 only one compressed air connector 66 on the right side is shown).

Each slot nozzle thus has as an essential part a compression chamber 70 disposed at the side of the spreading extruder, which narrows downwardly to its narrowest cross section 71 where the output openings 72 with Laval enlargements adjoin. By means of the slot nozzles with their Laval enlargements operating with low pressure, the warp is also loosened by outwardly directed shock waves in a direction crosswise to the longitudinal slit or exit 68 of the spreading extruder 26. This results in achieving a more even distribution.

It can be seen in FIG. 6 that the nozzle body 69 minimally extends beyond the exit 68 at the bottom. This makes it possible that the shock waves generated by the sudden change between the pressure at the exit 68 of the spreading nozzle and at the output openings 72 of the slot nozzles at first act from the inside to the outside. Then the shock waves occuring thereafter from the outside to the inside create strong turbulences with the former which—as mentioned hereinbefore—also loosen and distribute the warp crosswise to the longitudinal slit or exit 68.

By insertion of the slot nozzles 69 and, if necessary, also the propelling nozzle 22, the ratios of length to diameter $l_1/d_1$ and $l_2/d_2$ can be varied. The ratio $l_1/d_1$ is approximately 110 to obtain a maximum filament draw-off force. The filament guide tube 20 decisively determines the flow-through resistance, and here the ratio $l_2/d_2$ is selected such that the flow-through resistance already mentioned above of less than 0.01 bar results. Within the scope of the invention here are, of course, other values possible for the conditions mentioned.

What is claimed is:

1. A process for the production of a non-woven material from endless filaments and a substrate comprising the steps of:

supplying to an input side of a filament draw-off nozzle a first gaseous propellant having a first predetermined input pressure and input volume to establish a filament draw-off force which draws endless filaments from spinnerets in the form of a warp into one end of a filament guide tube and moves said warp downwardly through said filament guide tube;

spreading said warp at the other end of said filament guide tube with a spreading extruder having Coanda shells that is attached to said filament guide tube so that said individual filaments are distributed in a substantially uniform manner on a substrate located below said Coanda shells; and directing in a substantially downward direction at a location immediately above said Coanda shells a second gaseous propellant having a second predetermined input pressure and input volume that is lower than said first predetermined input pressure and input volume with at least one slot nozzle having a narrowing cross-section with its narrowest cross-section at an output opening to obtain further uniformity of said individual filaments distributed on said substrate to obtain said non-woven material.

2. A process according to claim 1 wherein a ratio of said first predetermined input pressure to said second predetermined input pressure is larger than 3.

3. A process according to claim 1 wherein during said directing step said second gaseous propellant is supplied by two slot nozzles, one slot nozzle on each side of said spreading extruder, and wherein each slot nozzle contains Laval enlargements.

4. A process according to claim 1 wherein said filament draw-off force formed during said supplying step is preserved during said directing step through a selection of a length and diameter of a filament offlet of said filament draw-off nozzle, a length and diameter of said filament guide tube, and said second predetermined input pressure and input volume.

5. A process according to claim 4 wherein a ratio of said length of said filament offlet to said diameter of said filament offlet lies between 80 and 180.

* * * * *